US008145342B2

(12) United States Patent
Bhagavat et al.

(10) Patent No.: US 8,145,342 B2
(45) **Date of Patent: *Mar. 27, 2012**

(54) METHODS AND SYSTEMS FOR ADJUSTING OPERATION OF A WAFER GRINDER USING FEEDBACK FROM WARP DATA

(75) Inventors: Sumeet S. Bhagavat, Creve Coeur, MO (US); Roland R. Vandamme, Wentzville, MO (US); Tomomi Komura, Utsunomiya (JP); Tomhiko Kaneko, Ageo (JP); Takuto Kazama, Utsunomiya (JP)

(73) Assignee: MEMC Electronic Materials, Inc., St. Peters, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/891,357

(22) Filed: Sep. 27, 2010

(65) Prior Publication Data

US 2011/0045740 A1 Feb. 24, 2011

Related U.S. Application Data

(60) Division of application No. 11/967,743, filed on Dec. 31, 2007, which is a continuation-in-part of application No. 11/617,430, filed on Dec. 28, 2006, now Pat. No. 7,662,023, and a continuation-in-part of application No. 11/617,433, filed on Dec. 28, 2006, now Pat. No. 7,601,049.

(60) Provisional application No. 60/763,456, filed on Jan. 30, 2006.

(51) Int. Cl.

| | |
|---|---|
| ***G06F 19/00*** | (2011.01) |
| ***G03C 5/00*** | (2006.01) |
| ***G03F 7/00*** | (2006.01) |
| ***H01L 21/302*** | (2006.01) |
| ***H01L 21/461*** | (2006.01) |
| ***B24B 49/00*** | (2012.01) |
| ***B24B 51/00*** | (2006.01) |
| ***B24B 1/00*** | (2006.01) |
| ***B24B 7/00*** | (2006.01) |
| ***B24B 9/00*** | (2006.01) |
| ***B24B 29/00*** | (2006.01) |
| ***B24B 5/00*** | (2006.01) |

(52) U.S. Cl. ..... 700/121; 451/8; 451/9; 451/10; 451/11; 451/41; 451/54; 451/261; 451/262; 451/268; 451/269; 451/287; 430/30; 430/311; 438/691; 438/745; 438/747

(58) Field of Classification Search ..... 700/121; 451/8, 9, 10, 11, 41, 54, 261, 262, 268, 269, 451/287; 438/691, 745, 747; 430/30, 311
See application file for complete search history.

(56) References Cited

U.S. PATENT DOCUMENTS 2,448,751 A 9/1948 Volkel (Continued)

FOREIGN PATENT DOCUMENTS

CN 1667799 A1 9/2005

(Continued)

OTHER PUBLICATIONS

Grinding vs Lapping—The Process Explained; Wafer Gringing and Lapping Compared; http://www.logitech.uk.com/lapping.asp; Nov. 20, 2010; 3 pages.

(Continued)

*Primary Examiner* — Ronald D Hartman, Jr.
(74) *Attorney, Agent, or Firm* — Armstrong Teasdale LLP

(57) ABSTRACT

Processing a wafer using a double side grinder having a pair of grinding wheels. Warp data is obtained by a warp measurement device for measuring warp of a wafer as ground by the double side grinder. The warp data is received and a nanotopography of the wafer is predicted based on the received warp data. A grinding parameter is determined based on the predicted nanotopography of the wafer. Operation of the double side grinder is adjusted based on the determined grinding parameter.

34 Claims, 16 Drawing Sheets

U.S. PATENT DOCUMENTS

| | | | | |
|---|---|---|---|---|
| 5,347,761 | A | 9/1994 | Murai | |
| 5,402,354 | A | 3/1995 | Okino et al. | |
| 5,473,532 | A | 12/1995 | Unno et al. | |
| 5,625,561 | A | 4/1997 | Kato et al. | |
| 5,815,400 | A | 9/1998 | Hirai et al. | |
| 5,816,895 | A | 10/1998 | Honda | |
| 5,942,445 | A * | 8/1999 | Kato et al. | 438/691 |
| 5,989,108 | A | 11/1999 | Ikeda et al. | |
| 6,165,054 | A | 12/2000 | Abe et al. | |
| 6,198,294 | B1 | 3/2001 | Black | |
| 6,220,928 | B1 * | 4/2001 | Okabe et al. | 451/5 |
| 6,298,279 | B1 | 10/2001 | Shimada et al. | |
| 6,368,881 | B1 | 4/2002 | Brouillette et al. | |
| 6,402,588 | B1 * | 6/2002 | Matsuo et al. | 451/5 |
| 6,428,388 | B2 | 8/2002 | Molnar | |
| 6,479,386 | B1 | 11/2002 | Ng et al. | |
| 6,514,424 | B2 * | 2/2003 | Wenski et al. | 216/38 |
| 6,556,876 | B1 | 4/2003 | Prosack et al. | |
| 6,556,884 | B1 | 4/2003 | Miller et al. | |
| 6,594,024 | B1 | 7/2003 | Singh et al. | |
| 6,594,542 | B1 * | 7/2003 | Williams | 700/164 |
| 6,613,591 | B1 * | 9/2003 | Bhagavat et al. | 438/14 |
| 6,630,360 | B2 | 10/2003 | Christian et al. | |
| 6,635,500 | B2 | 10/2003 | Lewis | |
| 6,649,528 | B2 * | 11/2003 | Yanagisawa et al. | 438/706 |
| 6,652,358 | B1 | 11/2003 | Ikeda et al. | |
| 6,672,943 | B2 | 1/2004 | Vogtmann et al. | |
| 6,726,525 | B1 | 4/2004 | Kato et al. | |
| 6,739,944 | B2 | 5/2004 | Sandhu et al. | |
| 6,852,012 | B2 | 2/2005 | Vepa et al. | |
| 6,914,000 | B2 * | 7/2005 | Kamada | 438/692 |
| 6,951,502 | B2 * | 10/2005 | Koike et al. | 451/8 |
| 6,997,779 | B2 * | 2/2006 | Junge et al. | 451/11 |
| 7,070,477 | B2 | 7/2006 | Morisawa | |
| 7,150,674 | B2 | 12/2006 | Okura | |
| 7,174,520 | B2 | 2/2007 | White et al. | |
| 7,209,857 | B2 * | 4/2007 | Sato et al. | 702/155 |
| 7,273,685 | B2 * | 9/2007 | Sasazawa et al. | 430/30 |
| 7,332,437 | B2 * | 2/2008 | Nihonmatsu et al. | 438/691 |
| 7,416,962 | B2 | 8/2008 | Harrison et al. | |
| 7,601,049 | B2 * | 10/2009 | Bhagavat et al. | 451/9 |
| 7,636,611 | B2 | 12/2009 | Huandra | |
| 7,810,383 | B2 * | 10/2010 | Okabe et al. | 73/105 |
| 7,822,500 | B2 | 10/2010 | Kobayashi et al. | |
| 8,029,339 | B2 * | 10/2011 | Kato et al. | 451/267 |
| 2002/0052064 | A1 * | 5/2002 | Grabbe et al. | 438/113 |
| 2002/0052169 | A1 * | 5/2002 | Vepa et al. | 451/11 |
| 2002/0086625 | A1 | 7/2002 | Vepa et al. | |
| 2002/0102920 | A1 * | 8/2002 | Vogtmann et al. | 451/41 |
| 2002/0185053 | A1 | 12/2002 | Fei et al. | |
| 2003/0017787 | A1 | 1/2003 | Weldon et al. | |
| 2003/0055612 | A1 | 3/2003 | Amakai et al. | |
| 2003/0060050 | A1 | 3/2003 | Pietsch et al. | |
| 2003/0171075 | A1 * | 9/2003 | Nihonmatsu et al. | 451/41 |
| 2003/0186546 | A1 | 10/2003 | Wollstein et al. | |
| 2004/0043616 | A1 | 3/2004 | Harrison et al. | |
| 2004/0248411 | A1 * | 12/2004 | Ushio et al. | 438/689 |
| 2005/0173377 | A1 | 8/2005 | Pietsch et al. | |
| 2005/0202757 | A1 | 9/2005 | Junge et al. | |
| 2006/0009125 | A1 | 1/2006 | Okura | |
| 2006/0110837 | A1 | 5/2006 | Gupta et al. | |
| 2007/0006652 | A1 | 1/2007 | Weldon, Jr. et al. | |
| 2007/0100489 | A1 | 5/2007 | Huandra | |
| 2007/0128983 | A1 * | 6/2007 | Walsh et al. | 451/5 |
| 2007/0179660 | A1 | 8/2007 | Bhagavat et al. | |
| 2007/0243795 | A1 | 10/2007 | Kobayashi et al. | |
| 2008/0166823 | A1 | 7/2008 | Okabe et al. | |
| 2008/0233840 | A1 | 9/2008 | Pietsch et al. | |

FOREIGN PATENT DOCUMENTS

| | | | |
|---|---|---|---|
| DE | 102004011996 | A1 | 9/2005 |
| EP | 0665481 | A2 | 8/1995 |
| EP | 0755751 | A1 | 1/1997 |
| EP | 1118429 | A1 | 7/2001 |
| EP | 1457828 | A2 | 9/2004 |
| JP | 11-198009 | * | 7/1999 |
| JP | 2000280155 | | 10/2000 |
| JP | 2002307303 | A1 | 10/2002 |
| WO | 0211947 | A2 | 2/2002 |
| WO | 2005095054 | A1 | 10/2005 |
| WO | 2007130708 | A1 | 11/2007 |

OTHER PUBLICATIONS

"Defect BitCell, Test, Data Transfer and Storage Software", Zenpire, http://www.zenpire.com/products/iFabDefect01.html, accessed Dec. 10, 2005, 4 pages.

"Grinding Machines for Semiconductor Wafers", Crystec Technology Trading GmbH, http://www.crystec.com/kmisemie.htm, accessed Oct. 12, 2005, 4 pages.

"Intelligent Defect Analysis of Software", SiGlaz, http://www.siglaz.com, accessed Dec. 10, 2005; 7 pages.

"STDF Examinator Ideal for Semiconductor Defect Analysis!", Galaxy, http://www.galaxysemi.com/examinator/description/search/examinator_defect.htm, accessed Dec. 10, 2005, 5 pages.

"Using SSA to measure the efficacy of automated defect data gathering", MICRO Magazine, http://www.micromagazine.com/archive/98/04/tobin.html, accessed Dec. 10, 2005, 10 pages.

"Defect Signature Analyzer", SiGlaz, SiGlaz, http://www.siglaz.com, accessed Dec. 10, 2005, 2 pages.

"Automotion Workbench", SiGlaz, http://www.siglaz.com, accessed Dec. 10, 2005 2 pages.

"Real-Time Process Monitor", SiGlaz, http://www.siglaz.com, accessed Dec. 10, 2005, 2 pages.

"Intelligent Reporting System", SiGlaz, http://www.siglaz.com, accessed Dec. 10, 2005, 2 pages.

International Search Report for application No. PCT/US2007/060981; mailed on Jul. 24, 2007; 4 pages.

PCT International Search Report and Written Opinion of the International Searching Authority mailed on Apr. 27, 2009 regarding PCT/US2008/088452 filed on Dec. 29, 2008, 15 pages.

Singapore Search Report and Written Opinion mailed on Aug. 19, 2010 regarding Singapore Patent Application No. 200805494-2 filed on Jan. 24, 2007, 10 pages.

Singapore Communication Examiners Search Report and Written Opinion regarding Application No. 201003886-7 dated Sep. 22, 2011; 17 pages.

European Communication Examiners Report regarding Application No. 08869803.0-1262 dated Aug. 31, 2011; 5 pages.

* cited by examiner

METHODS AND SYSTEMS FOR ADJUSTING OPERATION OF A WAFER GRINDER USING FEEDBACK FROM WARP DATA

CROSS-REFERENCE TO RELATED APPLICATION

This application is a divisional of co-pending U.S. patent application Ser. No. 11/967,743, which is a continuation-in-part of U.S. patent application Ser. No. 11/617,430 (now U.S. Pat. No. 7,662,023) filed Dec. 28, 2006, and of U.S. patent application Ser. No. 11/617,433 (now U.S. Pat. No. 7,601,049) filed Dec. 28, 2006, both of which claim the benefit of U.S. Provisional Application No. 60/763,456, filed Jan. 30, 2006, the entire disclosures of which are incorporated herein by reference.

BACKGROUND OF THE INVENTION

Aspects of the invention relate generally to processing semiconductor wafers and more particularly to controlling and optimizing wafer nanotopography during processing.

Semiconductor wafers are commonly used as substrates in the production of integrated circuit (IC) chips. Chip manufacturers require wafers that have extremely flat and parallel surfaces to ensure that a maximum number of chips can be fabricated from each wafer. After being sliced from an ingot, wafers typically undergo grinding and polishing processes designed to improve certain surface features, such as flatness and parallelism.

Simultaneous double side grinding operates on both sides of a wafer at the same time and produces wafers with highly planarized surfaces. Grinders that perform double side grinding include, for example, those manufactured by Koyo Machine Industries Co., Ltd. These grinders use a wafer-clamping device to hold the semiconductor wafer during grinding. The clamping device typically comprises a pair of hydrostatic pads and a pair of grinding wheels. The pads and wheels are oriented in opposed relation to hold the wafer therebetween in a vertical orientation. The hydrostatic pads beneficially produce a fluid barrier between the respective pad and wafer surface for holding the wafer without the rigid pads physically contacting the wafer during grinding. This reduces damage to the wafer that may be caused by physical clamping and allows the wafer to move (rotate) tangentially relative to the pad surfaces with less friction. While this grinding process can improve flatness and/or parallelism of the ground wafer surfaces, it can cause degradation of the topology of the wafer surfaces. Specifically, misalignment of the hydrostatic pad and grinding wheel clamping planes are known to cause such degradation. Post-grinding polishing produces a highly reflective, mirrored wafer surface on the ground wafer but does not address topology degradation.

In order to identify and address topology degradation concerns, device and semiconductor material manufacturers consider the nanotopography of the wafer surfaces. For example, Semiconductor Equipment and Materials International (SEMI), a global trade association for the semiconductor industry (SEMI document 3089), defines nanotopography as the deviation of a wafer surface within a spatial wavelength of about 0.2 mm to about 20 mm. This spatial wavelength corresponds very closely to surface features on the nanometer scale for processed semiconductor wafers. Nanotopography measures elevational deviation of one surface of the wafer and does not consider thickness variations of the wafer, as with traditional flatness measurements. Two techniques, light scattering and interferometry, are generally used to measure nanotopography. These techniques use light reflected from a surface of a polished wafer to detect very small surface variations.

Although nanotopography (NT) is not measured until after final polishing, double sided grinding is one process that affects the NT of finished wafers. In particular, NT defects like C-Marks and B-Rings take form during grinding process from misalignment of the hydrostatic pad and grinding wheel clamping planes and may lead to substantial yield losses. Current techniques designed to reduce NT defects caused by misalignment of hydrostatic pad and grinding wheel clamping planes include manually re-aligning the clamping planes. Unfortunately, the dynamics of the grinding operation and the effects of differential wear on the grinding wheels cause the planes to diverge from alignment after relatively few operations. The alignment steps, which are highly time consuming when performed by an operator, must be repeated so often as to make it a commercially impractical way of controlling operation of the grinder. Additionally, current techniques do not inform the operator of the particular adjustments that should be made to the clamping planes. Instead, the operator is merely provided with data describing the surface of the wafer and then uses trial and error to find an alignment that reduces the nanotopography degradation. Accordingly, the manual alignments are inconsistent among operators and often fail to improve wafer nanotopography.

Further, there is usually some lag between the time that undesirable nanotopography features are introduced into a wafer by a double side grinder and the time they are discovered. After double side grinding, the wafer undergoes various downstream processes like edge polishing, double sided polishing, and final polishing as well as measurements for flatness and edge defects before the NT is checked by a nanomapper or the like. Thus, wafer nanotopography is not known near the time that the wafer is removed from the grinder. Instead, nanotopography is only determined by conventional processes after the ground wafer has been polished in a polishing apparatus. As such, undesirable nanotopography features introduced into the wafer by the double side grinder cannot be identified until post-polishing. Moreover, the wafer is not measured until the cassette of wafers is machined. If suboptimal settings of the grinder cause an NT defect, then, it is likely that all the wafers in the cassette will have this defect leading to larger yield loss. In addition to this unavoidable delay in conventional wafer processes, the operator must wait for each cassette to be processed before getting feedback from the measurements. This leads to a considerable amount of down-time. If the next cassette is already ground before receiving the feedback, there is a risk of even more yield loss in the next cassette due to improper grinder settings.

BRIEF SUMMARY

Aspects of the invention permit nanotopography feedback in less time, allowing adjustments that can be made to improve nanotopography to be recognized and implemented with less lag time for improved quality control and/or wafer yield. According to one aspect of the invention, data indicative of a profile of a wafer ground using a double side grinder is used to predict a nanotopography of the ground wafer. A grinding parameter for improving the nanotopography of subsequently ground wafers is determined based on the predicted nanotopography. The operation of the double side grinder is adjusted in accordance with the determined grinding parameters. As such, aspects of the present invention provide improved nanotopography for wafers subsequently ground by the double side grinder. In another aspect, the present invention utilizes warp data to provide the nanotopography feedback. For example, the present invention may use warp data obtained from a warp measurement device generally used in wafer processing. As such, the present invention advantageously provides a cost-effective and convenient method for improving nanotopography.

A computer-implemented method of processing a wafer embodying aspects of the invention uses a double side grinder having at least a pair of grinding wheels. The method includes receiving, at a processor, data obtained by a warp measurement device for measuring warp of a wafer as ground by the double side grinder. The received warp data is indicative of the measured warp. The method also includes predicting a nanotopography of the wafer based on the received warp data and determining a grinding parameter based on the predicted nanotopography of the wafer. According to the method, instructions are provided for adjusting operation of the double side grinder based on the determined grinding parameter.

In another aspect, a computer-implemented method improves nanotopography of a wafer ground by a double side grinder. The computer-implemented method includes receiving, at a processor, data indicative of a profile of a wafer as ground by the double side grinder and predicting a nanotopography of the wafer based on the received data. A determination is made of a grinding parameter as a function of the received data. The method also includes providing feedback to the double side grinder. The feedback includes the determined grinding parameter to adjust operation of the grinder.

A system for processing a semiconductor wafer using a double side grinder having a pair of wheels also embodies aspects of the invention. The system includes a measurement device for measuring data indicative of a profile of the ground wafer, and a processor configured for determining a grinding parameter as a function of the measured data. In the system, at least one of the wheels of the double side grinder is adjusted based on the determined grinding parameter.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
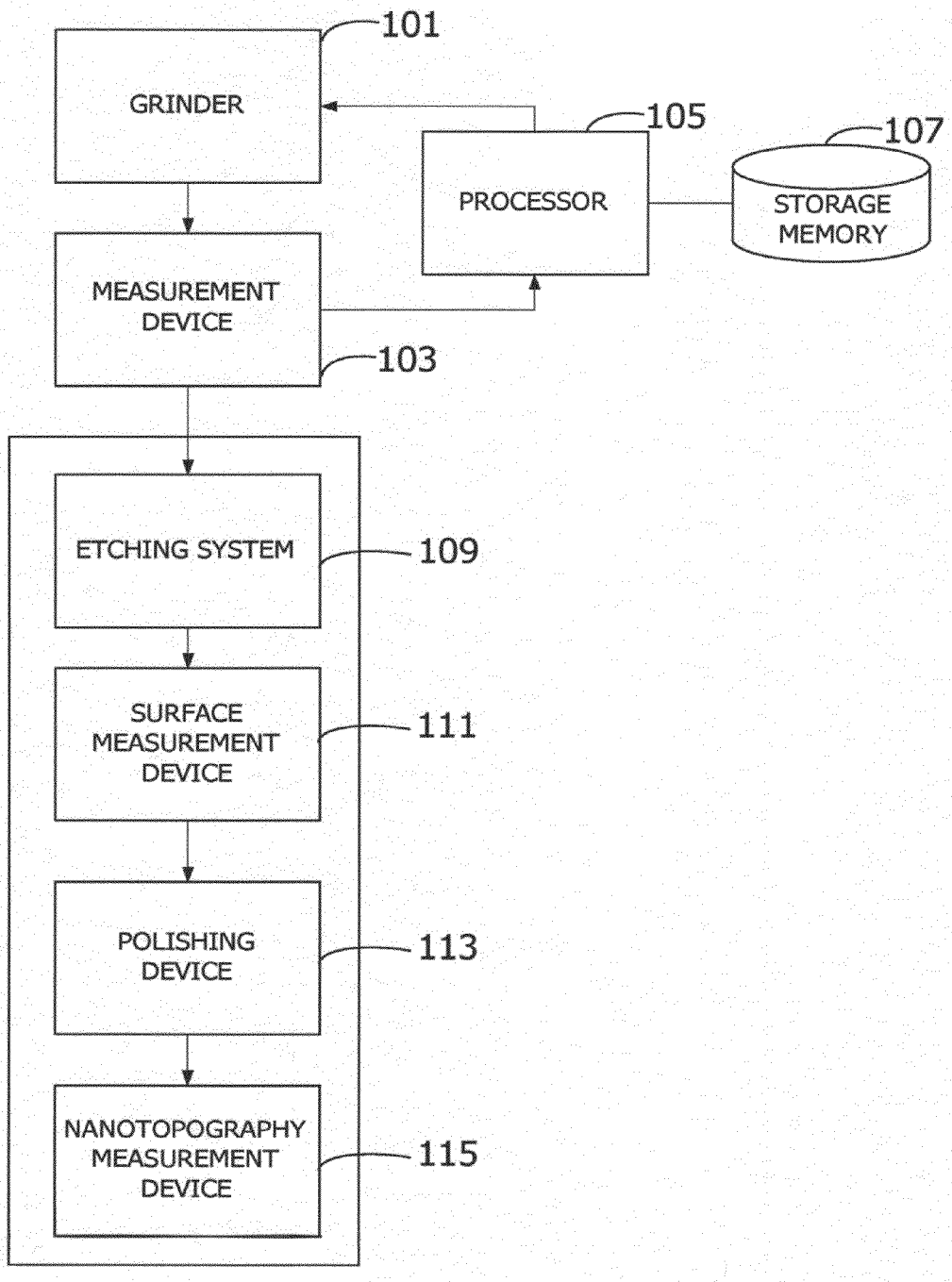
FIG. 1 is a block diagram illustrating a system for processing a semiconductor wafer according to an embodiment of the present invention.

Referring now to the drawings, aspects of the invention permit nanotopography feedback in less time, allowing adjustments that can be made to improve nanotopography to be recognized and implemented with less lag time for improved quality control and/or wafer yield. In FIG. 1, a block diagram illustrates a system for processing a semiconductor wafer according to an embodiment of the present invention. For purposes of illustration and not limitation, the system includes a grinder 101, a measurement device 103, and a processor 105 having a storage memory 107 associated therewith. The grinder 101 grinds a wafer and the measurement device 103 measures data indicative of a profile of the ground wafer. The ground wafer at this point is unetched and unpolished. The processor 105 is configured to provide feedback for adjusting a grinding parameter based on the measured data. For example, one or more of the grinding wheels of grinder 101 may be moved in order to improve the nanotopography of a wafer subsequently ground by the grinder.

In an alternative embodiment, the system includes a plurality of grinders 101, each grinding a wafer for further processing according to the system of FIG. 1. The measurement device 103 measures data indicative of profiles of the wafers ground by each of the plurality of grinders 101. The processor 105 is configured to provide feedback for each of the plurality of grinders 101 based on the measured data respectively corresponding to each of the plurality of grinders 101.

In the illustrated embodiment of FIG. 1, the system further includes one or more of the following post-grinding devices: an etching device 109 for etching the ground wafer, a surface measurement device 111 (e.g., a surface flatness measurement tool) for measuring the surface of the etched wafer, a polishing device 113 for polishing the etched wafer, and a nanotopography measurement device 115 for measuring the nanotopography of the polished wafer. For example, a suitable etching device 109 is the XS300-0100 rev C available from Atlas Corporation. A suitable surface measurement device 111 is the Wafercom 300 available from Lapmaster SFT Corporation. A suitable polishing device 113 is the MICROLINE® AC 2000-P2 from Peter Wolters GmbH of Germany A suitable nanotopography measurement device 115 is the NANOMAPPER® available from ADE Phase Shift. The grinder 101 may be further adjusted based on the measured nanotopography of the polished wafer.

Figure 2:
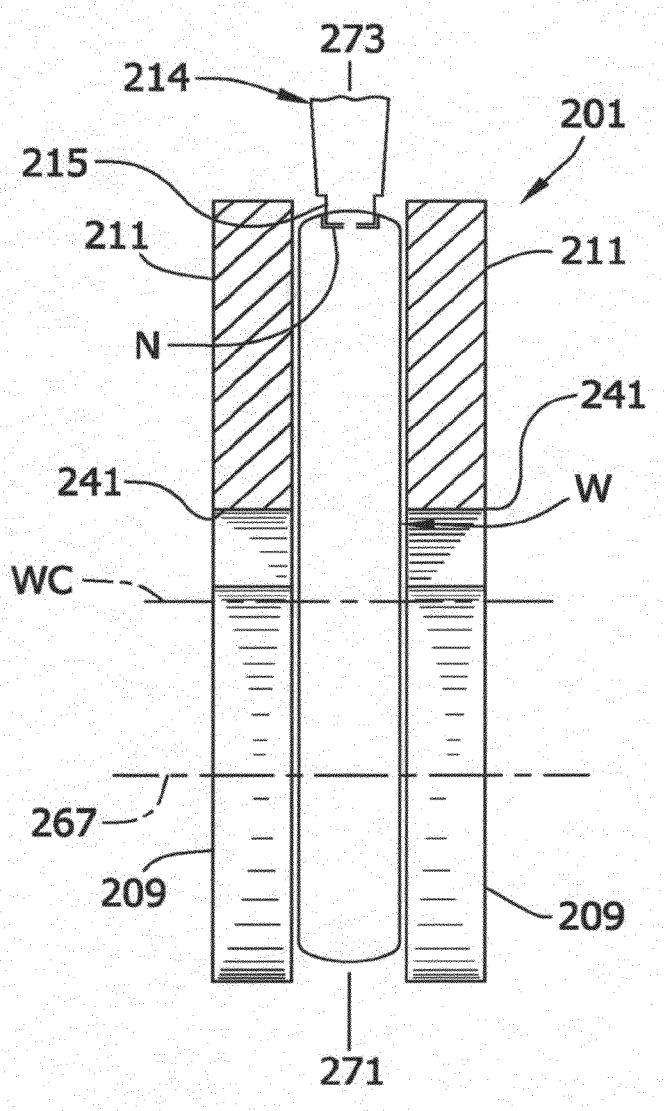
FIG. 2 is a schematic side elevation of a grinder having a wafer-clamping device and hydrostatic pads according to an embodiment of the present invention.

In one embodiment, the grinder 101 is a double side grinder. FIG. 2 illustrates a wafer-clamping device 201 of such a double side grinder. The clamping device 201 includes a pair of hydrostatic pads 211 and a pair of grinding wheels 209. The two grinding wheels 209 are substantially identical, and each wheel 209 is generally flat. The grinding wheels 209 and hydrostatic pads 211 hold a semiconductor wafer W (broadly a "workpiece") independently of one another, respectively defining clamping planes 271 and 273. A clamping pressure of the grinding wheels 209 on the wafer W is centered at a rotational axis 267 of the wheels, while a clamping pressure of the hydrostatic pads 211 on the wafer is centered near a center WC of the wafer.

Figure 3:
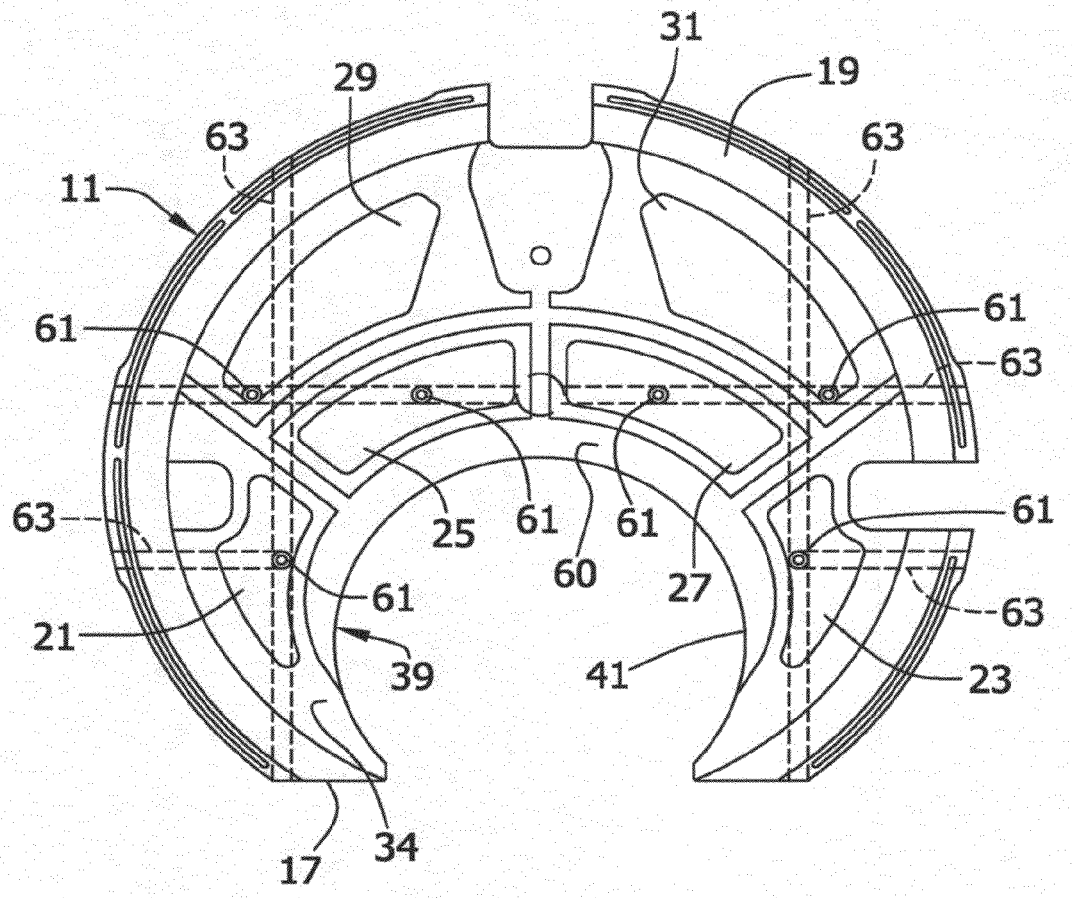
FIG. 3 is a wafer-side elevation of a hydrostatic pad which may be used in accordance with an embodiment of the invention.

The hydrostatic pads 211 remain stationary during operation while a drive ring, designated generally by reference numeral 241, moves the wafer W in rotation relative to the pads and grinding wheels 209. FIG. 3 illustrates an exemplary hydrostatic pad 211. The hydrostatic pad 211 includes hydrostatic pockets 221, 223, 225, 227, 229, and 231 each having a fluid injection port 261 for introducing fluid into the pockets. Channels 263 (illustrated by hidden lines) within the pad body 217 interconnect the fluid injection ports 261*a* and supply the fluid from an external fluid source (not shown) to the pockets. The fluid is forced into the pockets 221, 223, 225 227, 229, and 231*a* under relatively constant pressure during operation such that the fluid, and not the pad face 229, contacts the wafer W during grinding. In this manner, the fluid at pockets 221, 223, 225, 227, 229, and 231 holds the wafer W vertically within pad clamping plane 273 but still provides a lubricated bearing area, or sliding barrier, that allows the wafer W to rotate relative to the pad 211 during grinding with very low frictional resistance. Clamping force of the pad 211 is provided primarily at pockets 221, 223, 225, 227, 229, and 231.

Referring again to FIG. 2, as is known in the art, a detent, or coupon 215, of the drive ring 214 engages the wafer W generally at a notch N (illustrated by broken lines in FIG. 2) formed in a periphery of the wafer to move the wafer in rotation about its central axis WC. At the same time, the grinding wheels 209 engage the wafer W and rotate in opposite directions to one another. One of the wheels 209 rotates in the same direction as the wafer W and the other rotates in an opposite direction to the wafer. As long as clamping planes 271 and 273 are held coincident during grinding, the wafer remains in plane (i.e., does not bend) and is uniformly ground by wheels 209.

Figure 4:
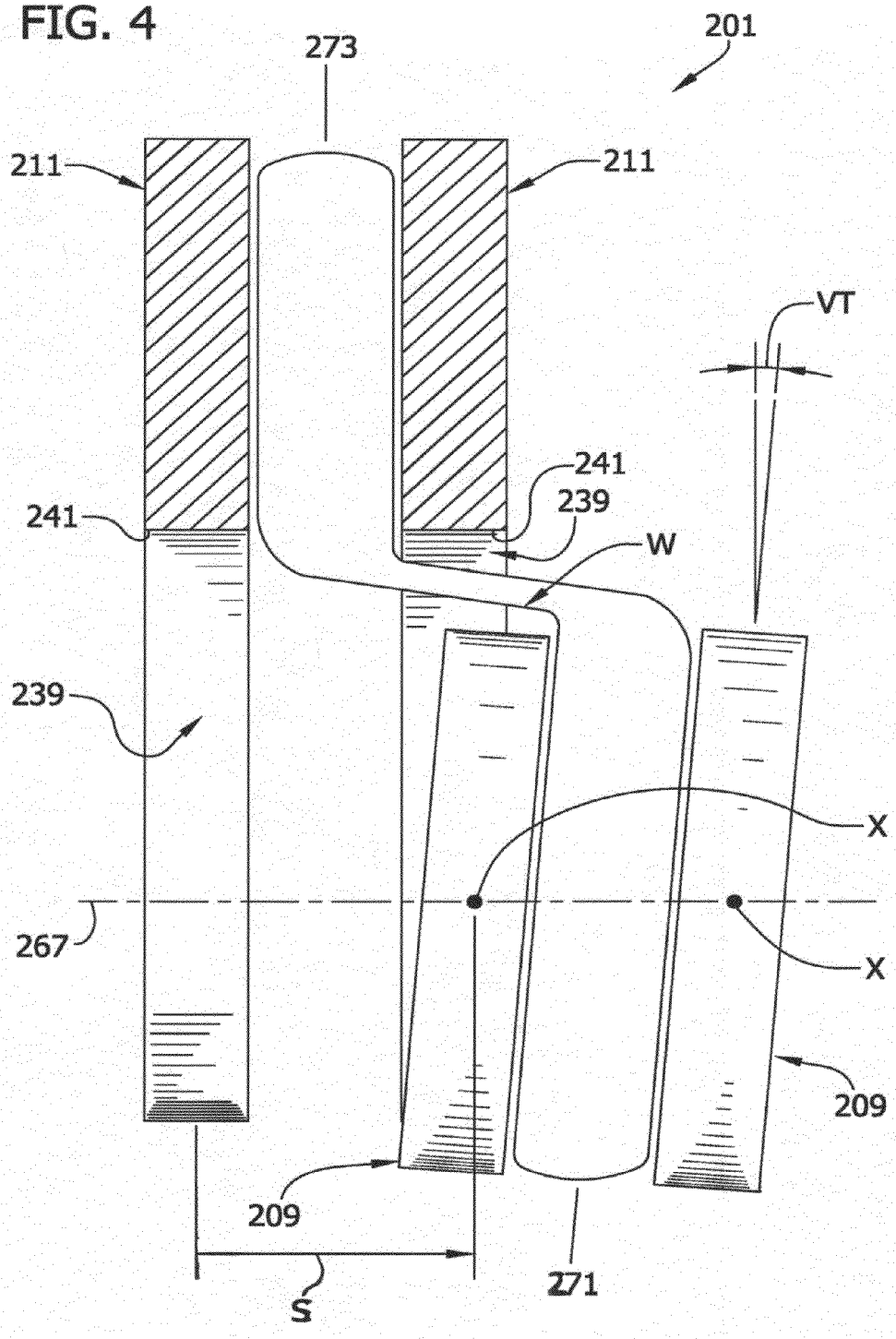
FIG. 4 is a schematic side elevation similar to FIG. 2, but showing exemplary lateral shifting and vertical tilting of the grinding wheels.
Figure 5A:
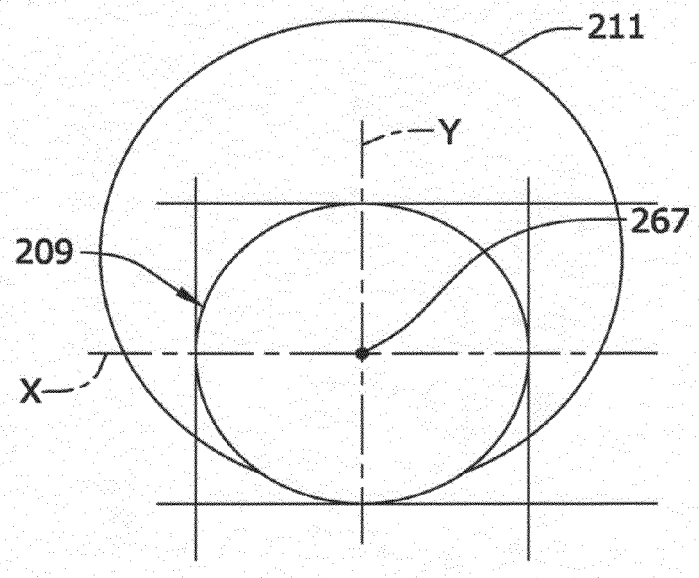
FIG. 5 is a schematic front elevation thereof illustrating horizontal tilt and vertical tilt of a grinding wheel.
Figure 5C:
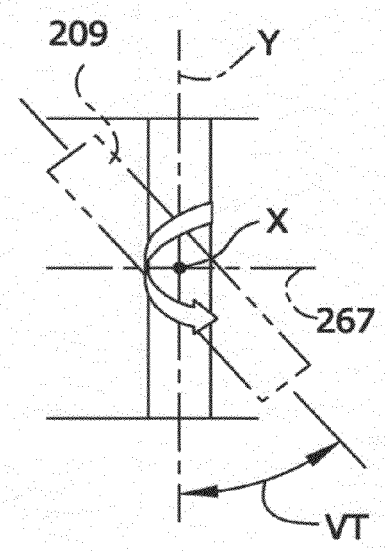
Figure 5B:
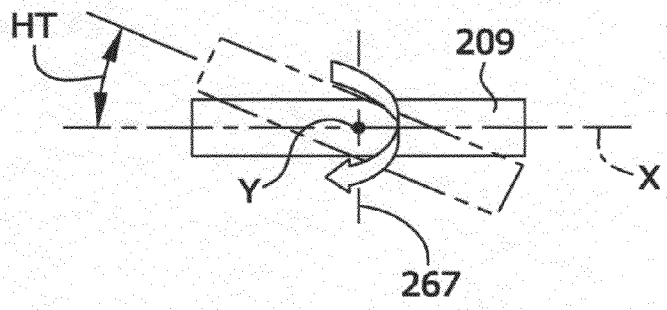

Misalignment of clamping planes 271 and 273 may occur during the double side grinding operation and is generally caused by movement of the grinding wheels 209 relative to the hydrostatic pads 211. Referring to FIGS. 4 and 5, three modes of misalignment or a combination thereof are used to characterize the misalignment of the clamping planes 271 and 273. In the first mode, there is a lateral shift S of the grinding wheels 209 relative to the hydrostatic pads 211 in translation along an axis of rotation 267 of the grinding wheels (FIG. 4). A second mode is characterized by a vertical tilt VT of the wheels 209 about a horizontal axis X through the center of the respective grinding wheel (FIGS. 4 and 5). FIG. 4 illustrates a combination of the first mode and second mode. In a third mode, there is a horizontal tilt HT of the wheels 209 about a vertical axis Y through the center of the respective grinding wheel (FIG. 5) 209. These modes are exaggerated in the drawings to illustrate the concept; it is understood that actual misalignment may be relatively small. In addition, each of the wheels 209 is capable of moving independently of the other so that horizontal tilt HT of the left wheel can be different from that of the right wheel, and the same is true for the vertical tilts VT of the two wheels 209.

As previously described, misalignment of the clamping planes 271 and 273 causes undesirable nanotopography features as measured by nanotopography measurement device 115. The undesirable nanotopography features may develop due to uneven grinding of the wafers and/or bending of the wafers. Additionally, misalignment of clamping planes 271 and 273 can cause the grinding wheels 209 to wear unevenly, which can further contribute to development of undesirable nanotopography features caused during the grinding of the wafer W. In some instances, wafers can develop undesirable features that cannot be removed by subsequent processing (e.g., polishing). Advantageously, the present invention minimizes the misalignment of the clamping planes. In particular, the grinding wheels 209 are adjusted by the processor 105 based on data obtained from ground wafers by the measurement device 103 rather than waiting until undesirable nanotopography features are detected by nanotopography measurement device 115.

In one embodiment, the measurement device 103 is a warp measurement device 103 configured to interface with the processor 105. As used by semiconductor wafer manufacturers, the warp measurement device 103 obtains (e.g., detects) warp data for a wafer and measures the warp of the wafer based on the warp data. In one embodiment, the warp measurement device 103 includes one or more capacitive sensors for obtaining the warp data. The obtained warp data is indicative of a profile (e.g., wafer shape) of the supported wafer.

Figure 6:
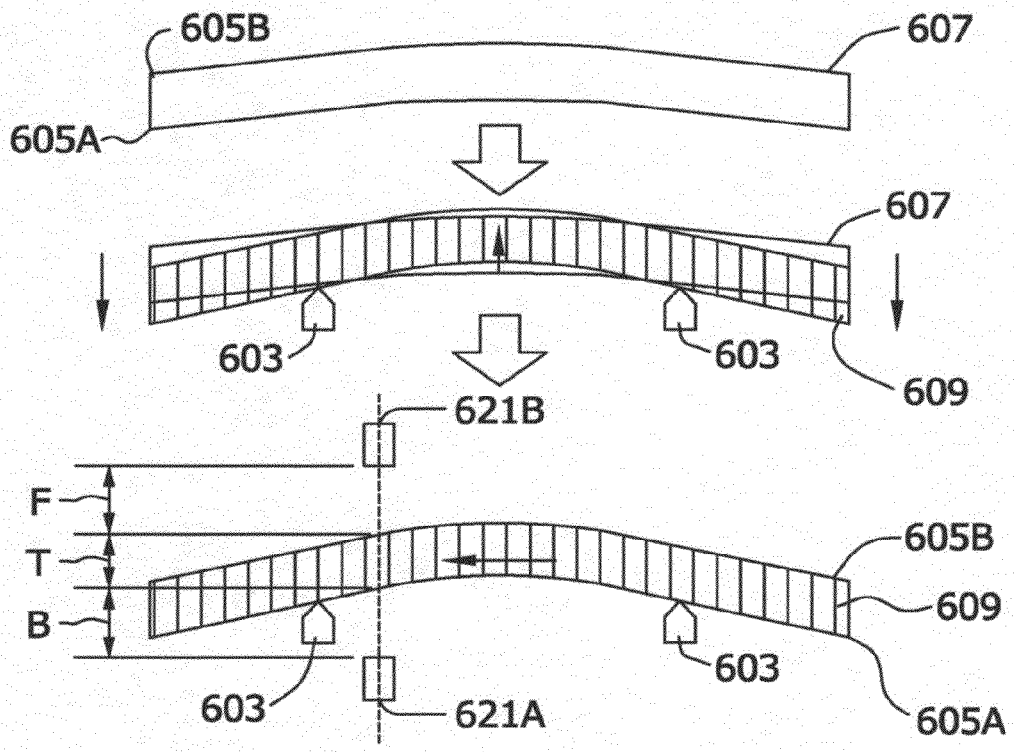
FIG. 6 is a diagram illustrating an exemplary line scanning process executed by a measurement device according to an embodiment of the invention.

For example, the warp measurement device 103 may execute a line scanning process as illustrated by FIG. 6. According to the line scanning process, the wafer W is supported by one or more support pins 603 in contact with a first surface 605 of the wafer. As illustrated by a comparison between a shape of the wafer in a gravity-free state (indicated with reference number 607) to a shape of the wafer in the supported state (indicated with reference number 609), the shape of the supported wafer 609 is deflected as a function of gravity and a mass of the wafer W. The warp measurement device 103 includes a first electrostatic capacitive sensor 621A for measuring a plurality of distances (e.g., "Distance-B") between the first sensor 621A and a first surface 605 (e.g., front surface) along a diameter of the supported wafer 609. Similarly, the warp measurement device 103 includes a second electrostatic capacitive sensor 621B for measuring a plurality of distances (e.g., "Distance-F") between the second sensor 621B and a second surface 605B (e.g., back surface) along a diameter of the supported wafer 609. The obtained warp data includes a line scan data set corresponding to the diameter. The line scan data set comprises the plurality of distances measured by the first sensor 621A along the diameter of the supported wafer 609 and the plurality of distances measured by the second sensor 621B along the diameter of the supported wafer 609. The line scan data set is indicative of the wafer profile along the diameter.

Figure 7A:
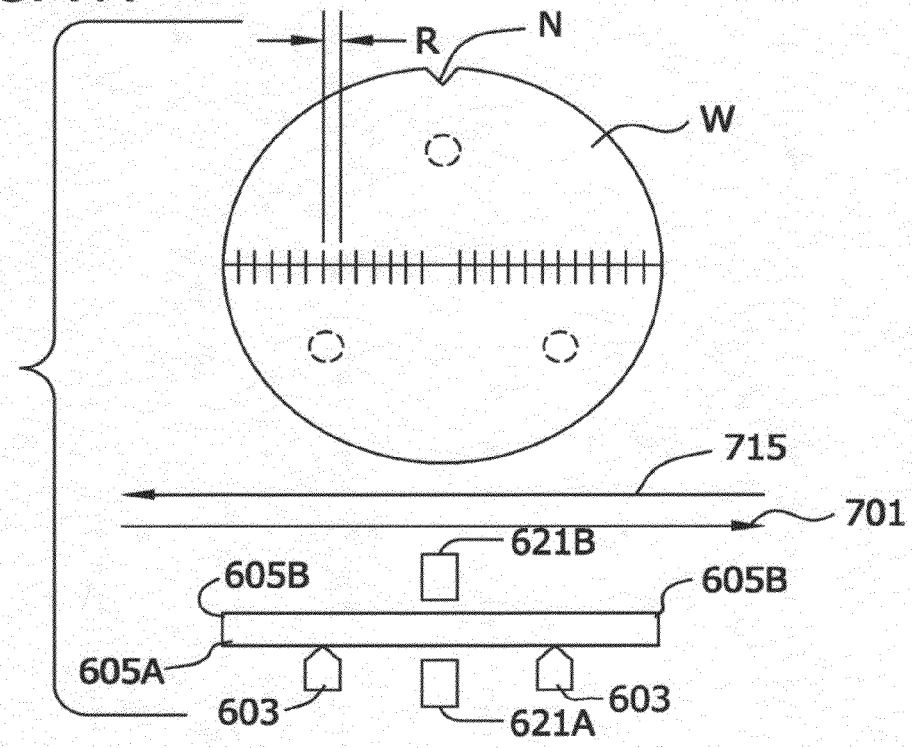
FIGS. 7A and 7B are diagrams further illustrating an exemplary line scanning process executed by a measurement device according to an embodiment of the invention.
Figure 7B:
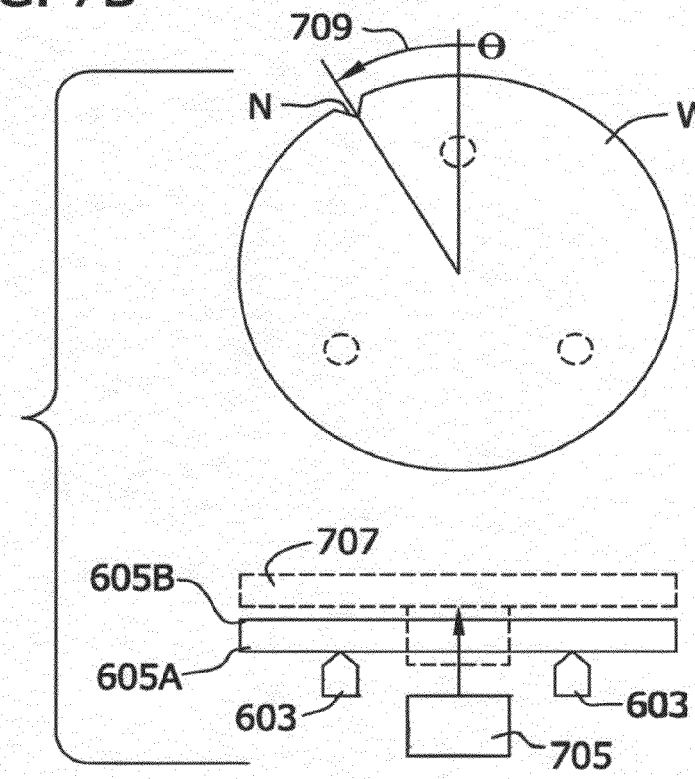

FIGS. 7A and 7B illustrate a line scanning process executed by a warp measurement device 103 for obtaining a plurality of line scan data sets, each indicative of a wafer profile along a particular diameter. As illustrated by FIG. 7A, a first line scan (indicated by arrow 701) is executed along a first diameter of the wafer. In particular, the first sensor 621A is moved in a plane above the first surface 605A in a first direction along the first diameter of the wafer. The first sensor 621A measures the distance between the first sensor 621A and the first surface 605A of the wafer at pre-defined intervals (i.e., pitch R, measurement frequency). The pre-defined intervals are illustrated as has marks on the surface of wafer W in FIG. 7A. For instance, the first sensor 621A may measure the distance at 1 or 2 mm intervals along the first diameter of the wafer. The second sensor 621B is similarly moved in a plane below the second surface 605B in the first direction to measure the distance between the second sensor 621B and the second surface 605B along the first diameter of the wafer. The first diameter of the wafer may be defined as a function of a reference point. For example, in the illustrated process, the first diameter passes through the notch N located on the perimeter of the wafer.

As illustrated by FIG. 7B, after completing the first line scan 701, the wafer W is rotated (indicated by arrow 709). In particular, a rotation stage 705, positioned below the support pins 603, is raised to lift the wafer W to a position (indicated by reference number 707) above the support pins 603. While supporting the wafer in the lifted position 707, the rotation stage rotates. As a result, the wafer is rotated a number of degrees (θ). The rotation stage 705 is lowered and the rotated wafer is re-positioned on the support pins 603. The positions of the support pins 603 with respect to the second surface of the wafer are indicated with hidden lines in FIGS. 7A and 7B. In turn, a line scan (indicated by arrow 715) along a second diameter of the wafer is executed. According to the illustrated process, the first and second sensors 621A and 621B are moved in planes respectively corresponding to the first and second surfaces 605A and 605B in a second direction (e.g., opposite to the first direction) along the second diameter of the wafer. As explained above in connection with the first line scan 701, the first and second sensors 621A and 621B respectively measure the distances between the sensors 621A and 621B and the first and second surfaces 605A and 605B of the wafer at the pre-defined intervals along the second diameter of the wafer. The rotation 709 and line scanning operations 701 and 705 are repeated in order to obtain each of the plurality of line scan data sets.

Figure 8A:
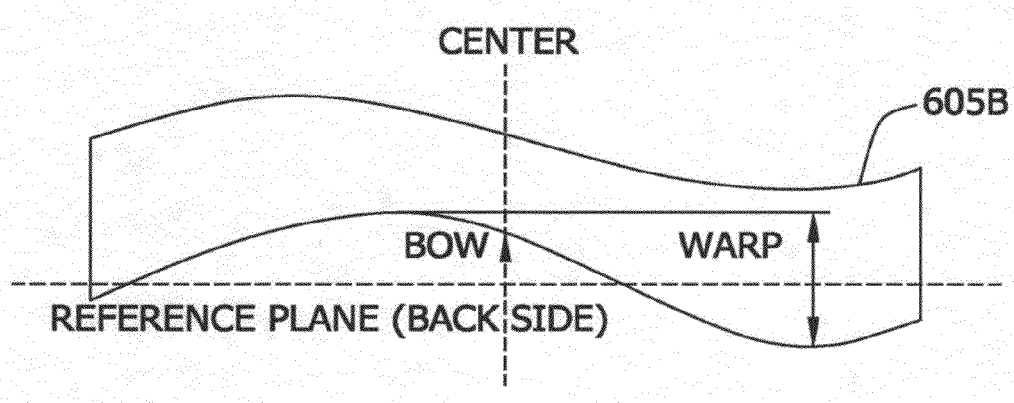
FIG. 8A is a side diagram of a wafer illustrating a warp parameter and a bow parameter for the wafer.
Figure 8B:
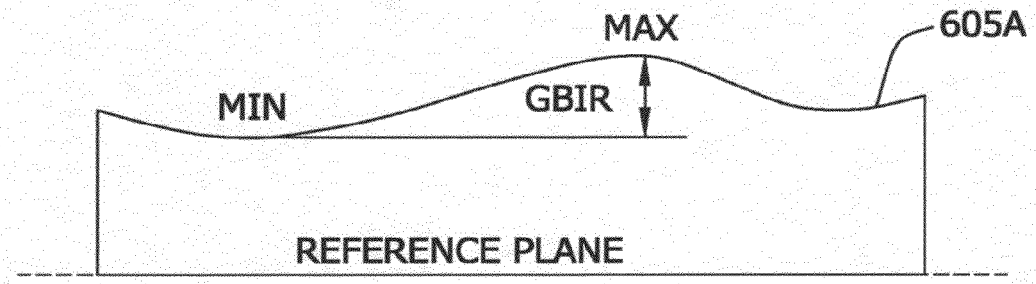
FIG. 8B is a side diagram of a wafer illustrating a thickness parameter for the wafer.

In one embodiment, the warp measurement device 103 uses a self mass compensation algorithm to determine the wafer shape for a gravity free state 607. The self mass compensation determines the shape of the wafer as a function of the line scan data sets, wafer density, an elastic constant, the diameter of the wafer, and the positions of the support pins 603. In one embodiment, warp measurement device 103 measures one or more wafer parameters based on the wafer shape. The wafer parameters may include one or more of the following: warp, bow, TTV (total thickness variation), and/or GBIR (global back surface ideal range). Referring to FIG. 8A, warp and bow are generally determined with respect to a reference plane. The reference plane is defined as a function the contact points between the support pins 603 and the surface of the wafer 605A. Specifically, warp is defined as the absolute value of the difference between maximum deviation and minimum deviation of the median area from the reference plane. The median area is a locus of points which are equidistant from the front surface 605B of the wafer and the back surface of the wafer 605A. Bow is defined as the amount of deviation from the reference plane at the wafer center. Referring to FIG. 8B, GBIR and TTV reflect the linear thickness variation of the wafer and can be computed based on a difference between a maximum and a minimum distance from the back surface of the wafer to the reference plane.

Referring again to the system illustrated in FIG. 1, the data obtained by the warp measurement device 103 for measuring warp of the wafer as ground by the grinder 101 is transmitted to the processor 105. For example, the line scan data sets and/or the determined wafer shape may be transmitted to the processor 105. The processor 105 receives the warp data and executes computer-executable instructions for performing a plurality of operations for processing the received warp data. In particular, the processor 105 predicts a nanotopography of the wafer based on the received warp data and determines a grinding parameter based on the predicted nanotopography of the wafer. The operation of the grinder 101 is adjusted accordingly. In one example, the processor 105 may execute computer-executable instructions embodied in one or more software applications, components within an application or software, executable library files, executable applets, or the like. The storage memory 107 associated with the processor 105 stores information and data for accessing by the processor 105. For example, the storage memory 107 may store data used by or accessed by the processor 105, such as software, applications, data, or the like.

In one embodiment, the storage memory 107 may be volatile or nonvolatile media, removable and non-removable media, and/or any available medium that may be accessed by a computer or a collection of computers (not shown). By way of example and not limitation, computer readable media include computer storage media. The computer storage media in any method or technology for storage of information such as computer readable instructions, data structures, program modules or other data. For example, computer storage media include RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium that may be used to store the desired information and that may be accessed by the computer.

In one embodiment, the processor 105 and the storage memory 107 may be incorporated into one or more computing devices. As known to those skilled in the art, computing devices include a combination of the following: a processor 105, one or more computer-readable media, an internal bus system coupling to various components within the computing devices, Input/Output devices, a networking device, and other devices. Exemplary computing devices include one or a combination of the following: a personal computer (PC), a workstation, a digital media player, and any other digital devices. In another embodiment, the processor 105 accesses data stored by storage memory 107 via a network.

In one embodiment, the processor 105 accesses a feedback program for processing the received warp data. The received warp data may include the line scan data sets and/or the determined wafer shape for the ground wafer. In particular, the processor 105 predicts a nanotopography of the wafer based on the received warp data. The nanotopography of the wafer is predicted, rather than actually measured, since when the measurement device 103 measures the wafer, the wafer has not yet undergone polishing. As previously discussed, current nanotopography measuring devices utilize technology which relies on the wafer being measured to be in a polished state. The processor 105 determines one or more grinding parameters based on the predicted nanotopography of the wafer. In one embodiment, the processor 105 determines a shift parameter. The shift parameter is indicative of a magnitude and a direction for moving the pair of grinding wheels 209 in order to reduce nanotopography degradation caused by misalignment of the grinding wheels 209. In another embodiment, the processor 105 additionally or alternatively determines a tilt parameter. The tilt parameter is indicative of an angle for positioning the pair of grinding wheels with respect to a wafer in order to reduce nanotopography degradation caused by misalignment of the grinding wheels 209.

The operation of the grinder 101 is adjusted based on the determined grinding parameters. For example, the grinding wheels may be adjusted as specified by the determined shift and/or tilt parameters. In one embodiment, the grinding wheels 209 are adjusted as a function of the determined shift and/or tilt parameters and of a previously defined compensation amount. In one embodiment, the grinder 101 is configured to receive the determined grinding parameters and adjust one or more components of the grinder 101 as a function of the determined grinding parameters. In another embodiment, the determined grinding parameters are provided to an operator and the operator configures the grinder 101 to adjust one or more components of the grinder 101 as a function of the determined grinding parameters.

Figure 9A:
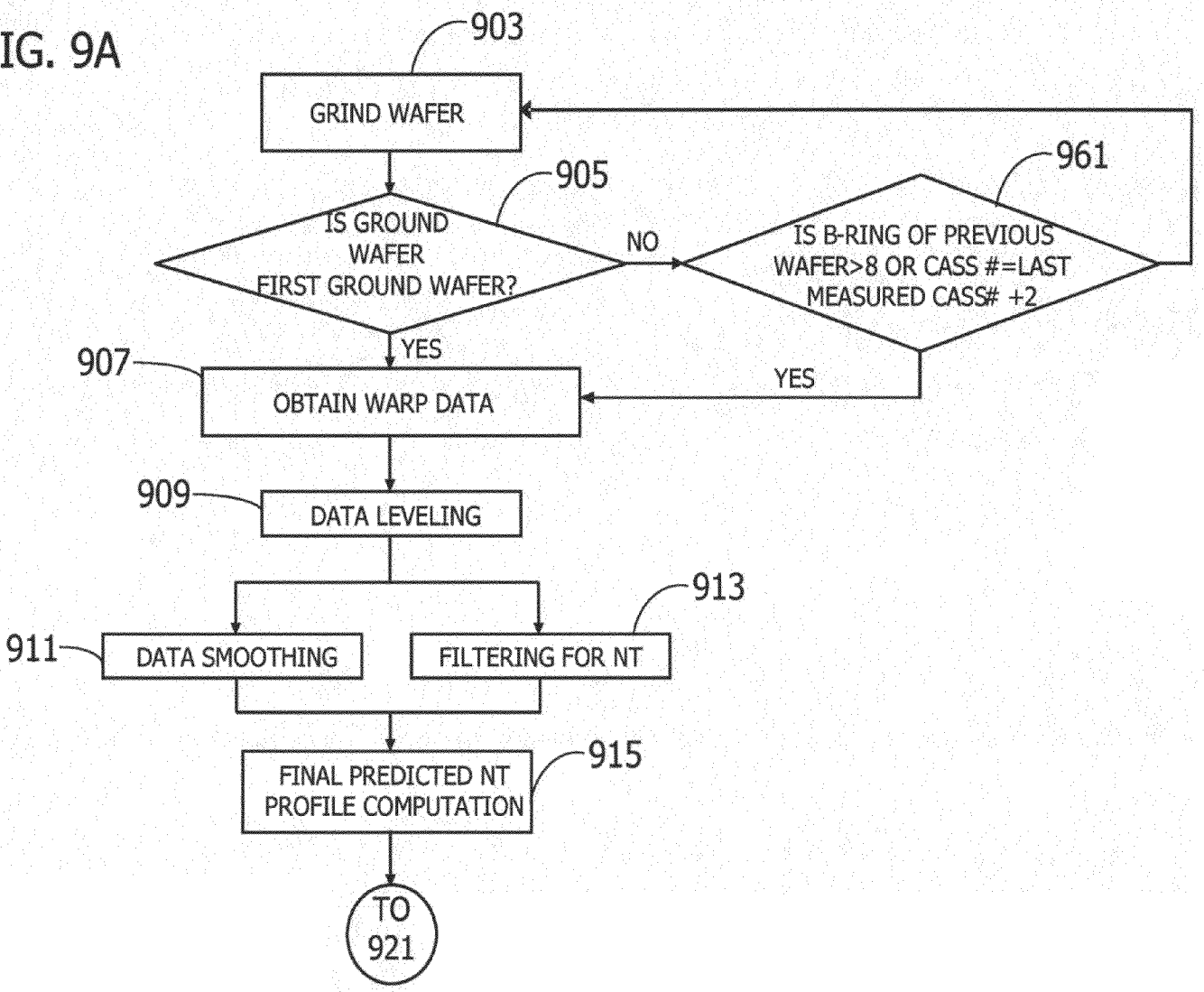
FIGS. 9A and 9B are exemplary flow diagrams illustrating a method for processing a wafer according to an embodiment of the invention.
Figure 9B:
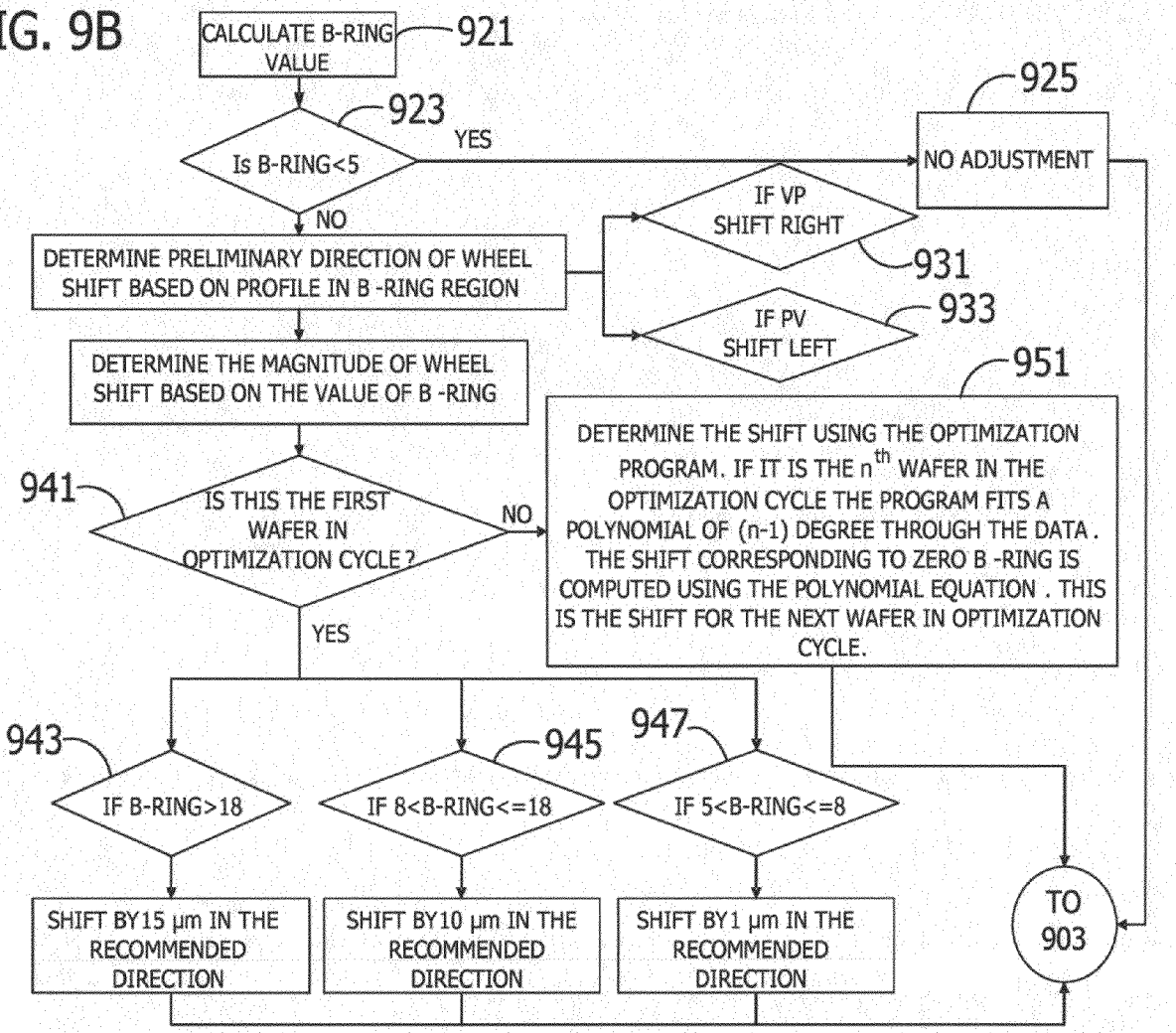
Figure 10:
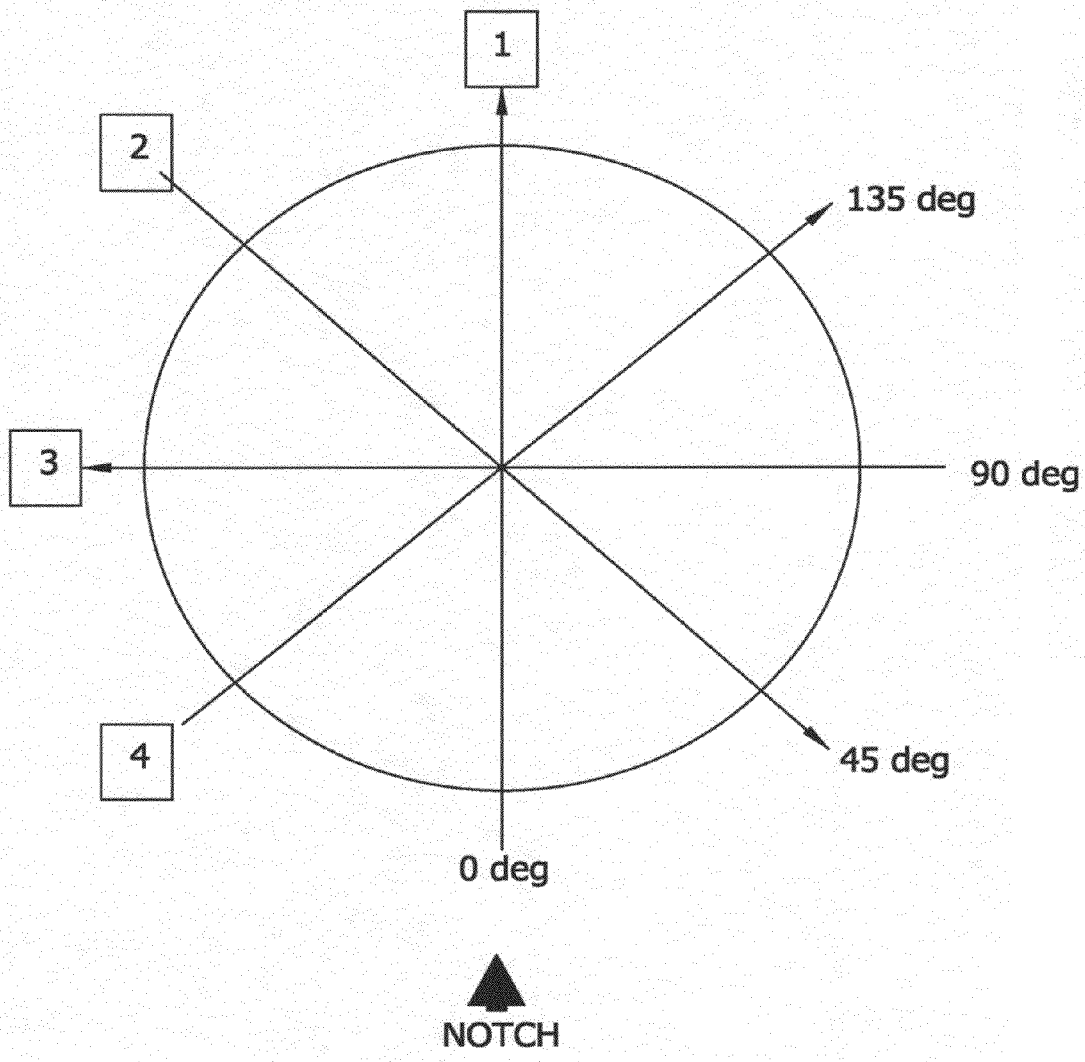
FIG. 10 is top side view of a wafer illustrating scan lines obtained for the wafer according to an embodiment of the invention.

FIGS. 9A and 9B illustrate an exemplary method of processing a wafer in accordance with an embodiment of the invention. At 903, a grinder 101 grinds a wafer. At 905, a determination is made whether the ground wafer is the first wafer. If the ground wafer is determined to be the first wafer, at 907 the measurement device 103 obtains data for measuring the warp and/or thickness of the first wafer. For example, the measurement device 103 may obtain four line scan data sets as illustrated by FIG. 10. Each line scan data set is indicative of a diametric profile of the wafer.

Referring to 909-915 as shown in FIG. 9A, processor 105 carries out operations for computing a predicted nanotopography profile for the first wafer. In particular, at 909, the processor 105 levels the warp data (e.g., a line scan data set) measured by the measurement device 103. In one embodiment, the measured warp data is leveled using a least square fit in a defined moving window. At 911, processor 105 is configured for computing a first profile as a function of the leveled data. Specifically, the leveled data is smoothed using a first filter (e.g., low pass filter) with a defined window size. At 913, a second profile is computed as a function of the leveled data. Specifically, the leveled data is filtered using a second filter with a defined window size. The second filter operates to substantially remove non-nanotopography wavelengths. At 915, a predicted nanotopography profile for the wafer is computed as a function of the computed first and second profiles. In one embodiment, the predicted NT profile is computed by subtracting the second profile from the first profile.

Figure 11:
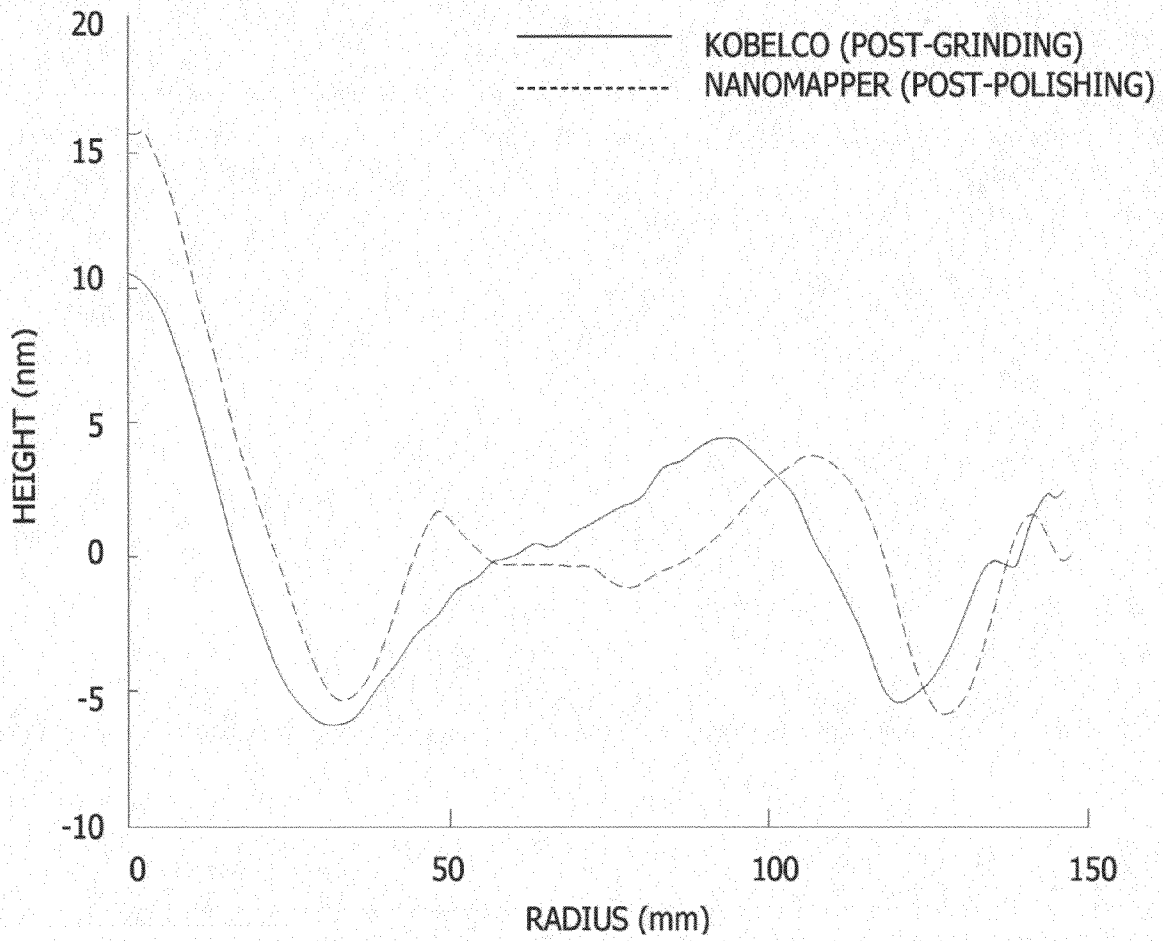
FIG. 11 is an exemplary graph comparing an average predicted post-grinding radial nanotopography profile obtained from warp data to a nanotopography post-polishing profile obtained by a nanotopography measurement device according to an embodiment of the invention.

According to aspects of the invention, processor 105 repeats operations at 909-915 to compute a predicted diametric nanotopography profile for each line scan data set obtained by the measurement device 103. According to the example illustrated by FIG. 10, four predicted diametric NT profiles are computed. Each of the four predicted diametric NT profiles are computed from one of the four line scan data sets. Eight predicted radial NT profiles are determined from the four predicted diametric NT profiles. Each of the eight predicted radial profiles represent predicted NT height data at a plurality of locations along a radius (e.g., ranging from 0-150 mm) of the wafer. An average predicted radial NT profile is computed by averaging the predicted NT height data for each of the eight predicted radial profiles as a function of the radius. FIG. 11 is a graph comparing an average predicted post-grinding radial NT profile obtained from warp data to an NT post-polishing profile obtained by a nanotopography measurement device.

Figure 12:
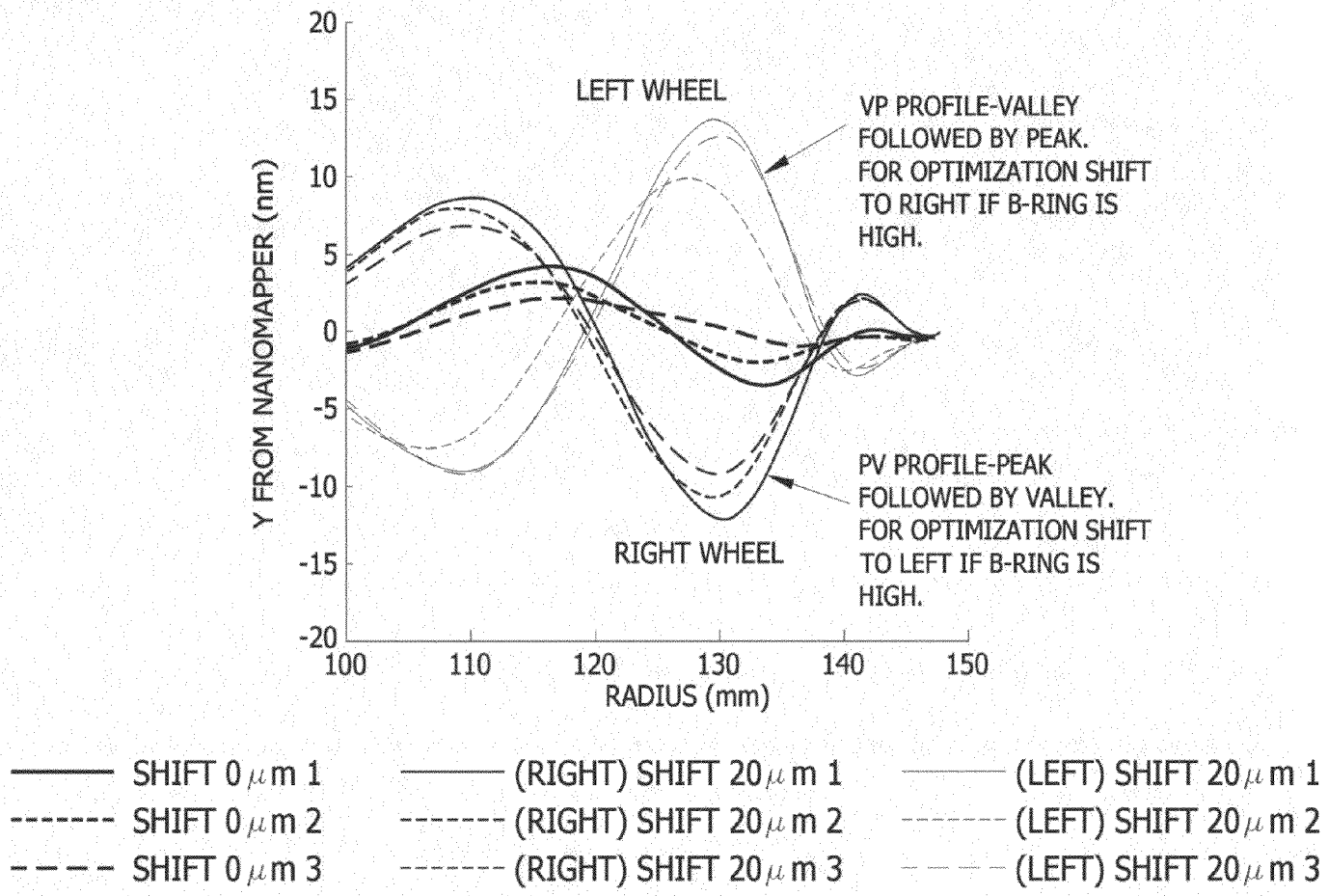
FIG. 12 is an exemplary graph illustrating an algorithm for determining a shift parameter based on a B-Ring region a predicted nanotopography profile according to an embodiment of the invention.
Figure 13:
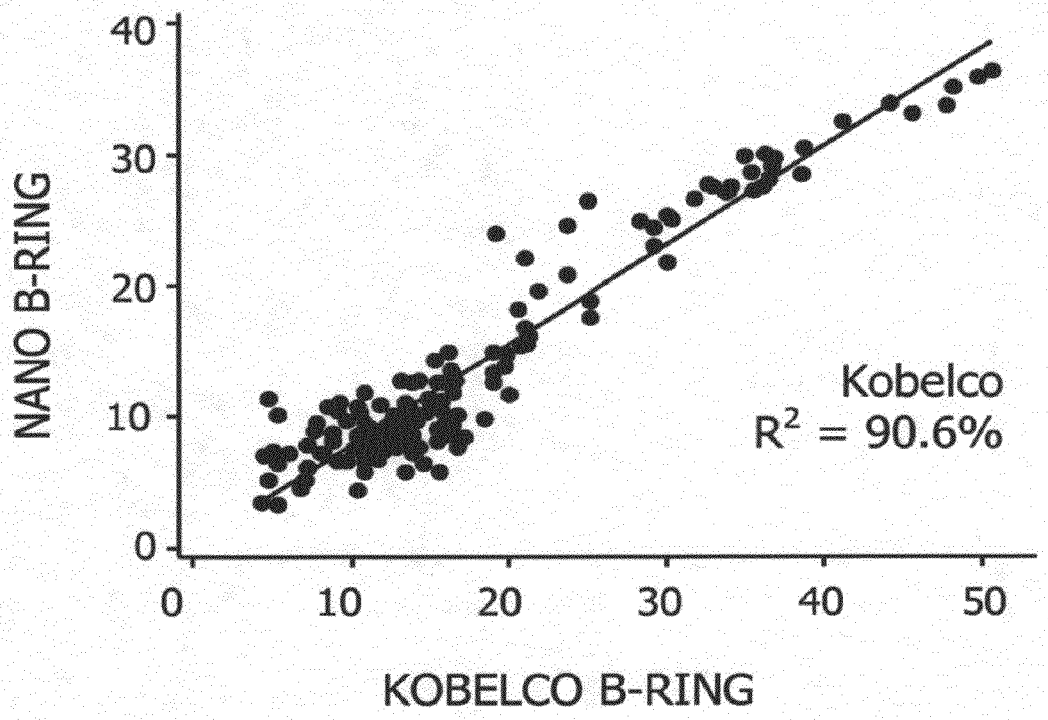
FIG. 13 is an exemplary graph comparing an average predicted nanotopography profile to a nanotopography profile actually measured for the B-Ring of a wafer according to an embodiment of the invention.
Figure 14:
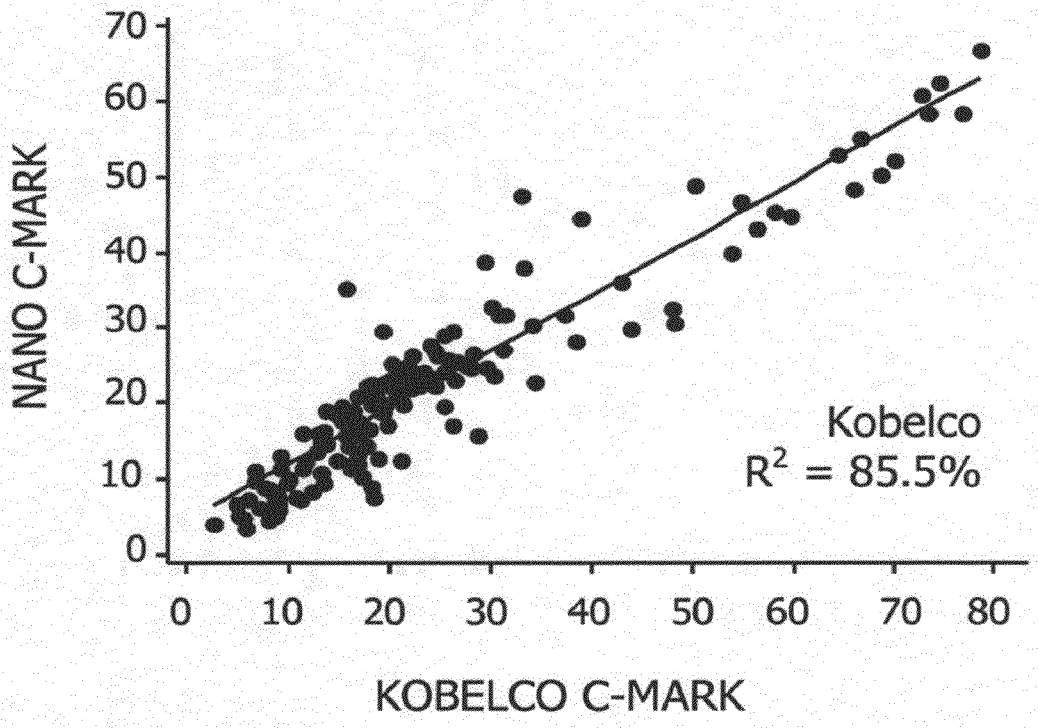
FIG. 14 is an exemplary graph comparing an average predicted nanotopography profile to a nanotopography profile actually measured for a C-Mark region of a wafer according to an embodiment of the invention.
Figure 15:
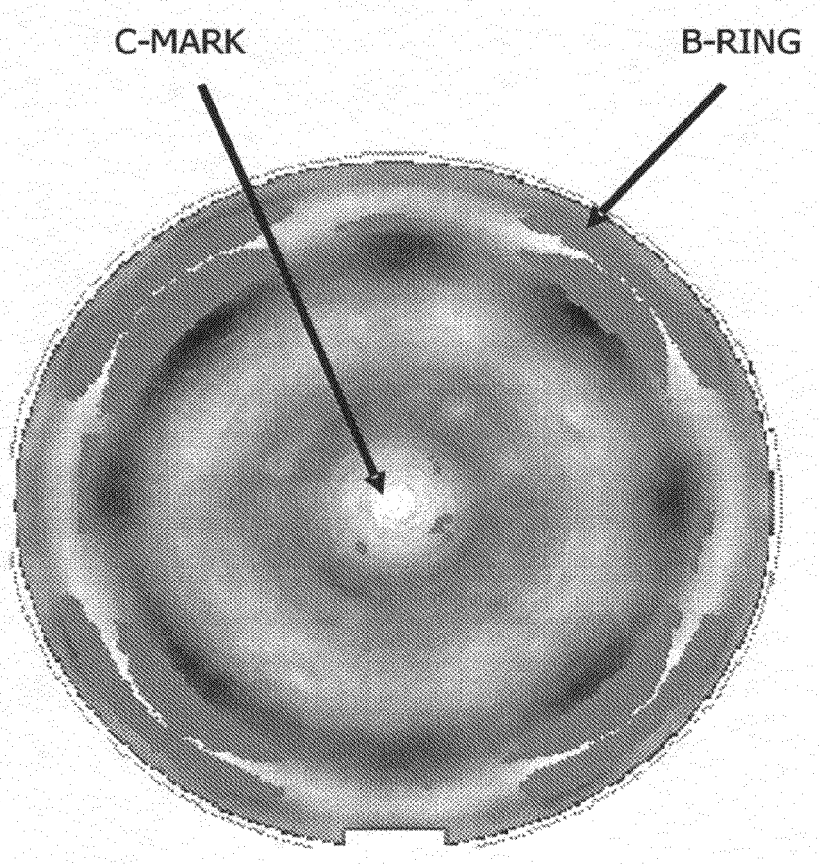
FIG. 15 is an exemplary topography map of a surface of a wafer illustrating a B-Ring and a C-Mark region.

FIG. 9B illustrates operations carried out by the processor 105 to determine the grinding parameters based on the predicted NT profile (e.g., average predicted radial NT profile). Specifically, the illustrated operations represent a fuzzy logic algorithm applied to the predicted NT profile to determine a shift parameter. The shift parameter has a direction component and a magnitude component for indicating a shift for the grinding wheels 209. According to the operations discussed in further detail below, the grinding parameters are determined based on the B-Ring region of the predicted NT profile. The B-Ring region refers to a region of the wafer where the radius is between 100 mm and 150 mm. The B-Ring value refers to a maximum peak-to-valley value in the B-Ring region for the average predicted radial NT profile. Generally, lower B-Ring values (e.g., less than 5 nm) correspond to more desirable nanotopography. FIG. 12 illustrates an exemplary algorithm which used to determine the shift parameter based on the B-Ring region of the average predicted NT profile. FIG. 13 is a graph comparing an average predicted NT profile to the NT profile actually measured for the B-Ring of the wafer. In another embodiment, a similar method (not illustrated) is carried to optimize the E-Mark. Like the B-Ring region, the E-Mark region refers to a region of the wafer where the radius is between 100 mm and 150 mm. The E-Mark value refers to a maximum peak to valley value determined from each of the predicted NT profiles (rather than the average predicted radial NT profile). In yet another embodiment, a similar method (not illustrated) is carried to optimize the C-Mark. The C-Mark region refers to a region of the wafer where the radius is between 0 mm and 50 mm. The C-Mark value refers to a maximum peak-to-valley value in the C-Mark region for the average predicted radial NT profile. FIG. 14 is a graph comparing an average predicted NT profile to the NT profile actually measured for the C-Mark region. FIG. 15 is an exemplary topography map of a surface of the wafer illustrating the B-Ring and the C-Mark regions.

Referring again to FIG. 9B, at 921, the processor 105 determines the B-Ring value for the predicted NT profile. At 923, the processor 105 determines whether the B-Ring value is less than a B-Ring value defined to be low (i.e., 5 nm). If the B-Ring value is low, the processor 105 determines at 925 that no adjustment is necessary (i.e., value of grinding parameters is zero). Alternatively, if the B-Ring value is not low (i.e., greater than or equal to 5 nm), an optimization cycle is initiated, and the present wafer is the first wafer in the optimization cycle. The optimization cycle carries out the remaining operations discussed below of the illustrated method for the present wafer and repeats the operations discussed above for a subsequent wafer. The optimization cycle is repeated until a subsequent wafer is ground by the grinder according to the grinding parameters has a B-Ring value determined to be less the defined low value (i.e., 5 nm).

According to the optimization cycle, the processor 105 determines a preliminary shift direction based on the predicted NT profile in the B-Ring region. Referring to 931, the processor 105 determines whether the predicted NT profile in the B-Ring region has a valley followed by a peak (referred to as a "VP profile"). If the predicted NT profile is determined to have a valley followed by a peak in the B-Ring region, the preliminary shift direction of the grinding wheels 209 is right. Referring to 933, the processor 105 similarly determines whether the predicted NT profile in the B-Ring region has a peak followed by a valley (referred to as a "PV profile"). If the predicted NT profile is determined to have a peak followed by a valley in the B-Ring region, the preliminary shift direction of the grinding wheels 209 is left.

After determining the preliminary shift direction, the processor 105 determines the shift magnitude based on the B-Ring value. At 941, the processor 105 determines whether the wafer is the first wafer in the optimization cycle. If the wafer is determined to be the first wafer in an optimization cycle, the processor 105 determines the shift magnitude used for grinding the next wafer ground by the grinder (i.e., the second wafer) based on predefined guidelines. In one embodiment, the pre-defined guidelines include a plurality of B-Ring value ranges, each of which are associated with a particular shift magnitude value. The particular shift magnitude value is selected to improve the nanotopograhy of wafers subsequently ground by the grinder 101. According to the illustrated method, at 943 the processor 105 determines whether the B-Ring value is greater than 18 nm. If the B-Ring value is determined to be greater than 18 nm, the shift magnitude is 15 μm and the shift direction is the determined preliminary shift direction. At 944 the processor 105 determines whether the B-Ring value is greater than 8 nm but less than or equal to 18 nm. If the B-Ring value is determined to be greater than 8 nm but less than or equal to 18 nm, the shift magnitude is 10 μm and the shift direction is the determined preliminary shift direction. At 944 the processor 105 determines whether the B-Ring value is greater than 8 nm but less than or equal to 18 nm. If the B-Ring value is determined to be greater than or equal to 5 nm but less than or equal to 8 nm, the shift magnitude is 1 μm and the shift direction is the determined preliminary shift direction.

If the processor 105 determines at 941 that the wafer is not the first wafer in the optimization cycle, the processor 105 executes at 951 an optimization program to determine the shift parameter used for grinding the next wafer. In particular, the number (n) of the wafer in the optimization cycle is identified and the shift parameter for the next wafer (n+1) is determined as a function of the B-Ring values and corresponding shift parameter values for n wafers. In one embodiment, the B-ring values and corresponding shift parameters for the n wafers are fitted using a polynomial fit of degree (n−1). The shift parameter determined using the nth wafer corresponds to a value of the polynomial when the B-Ring value is equal to zero.

As illustrated, processing according to an exemplary method embodying aspects of the invention returns to 903 after the shift parameter is determined at 943, 945, 947, or 951. Likewise, the optimization cycle ends and the method returns to 903 if the processor 105 determines that no adjustment to the grinder 101 is necessary at 925. At 903, the grinder 101 grinds the next wafer according to the determined grinding parameters (e.g., determined shift parameter). At 905, the processor 105 determines whether the next wafer is the first wafer. Since the next wafer is not the first wafer, the processor 105 determines at 961 whether one or more the of follow conditions is true: the B-Ring of the previous wafer is greater than a pre-determined value (e.g., 8 nm); the cassette number is two more than the cassette for which wafers were last measured by the measurement device 103. If one or more of the conditions are true the measurement device 103 obtains warp data for the wafer at 907 at the method proceeds as discussed above. If neither of the conditions is true, the wafer subsequent steps of the illustrated method are not performed for the wafer and the method returns to step 903 for grinding a subsequent wafer.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A computer-implemented method of processing a wafer using a double side grinder, the double side grinder having at least a pair of grinding wheels, the computer-implemented method comprising:

receiving, at a processor, data obtained by a warp measurement device for measuring warp of a wafer as ground by the double side grinder, the received warp data being indicative of the measured warp;

predicting a nanotopography of the wafer based on the received warp data;

determining a grinding parameter based on the predicted nanotopography of the wafer;

providing instructions for adjusting operation of the double side grinder based on the determined grinding parameter.

2. The computer-implemented method of claim 1 wherein providing instructions for adjusting operation of the double side grinder comprises providing feedback to the double side grinder, the feedback including the determined grinding parameter.

3. The computer-implemented method of claim 1 wherein the determining includes determining a shift parameter based on the predicted nanotopography of the wafer, the shift parameter indicative of a magnitude for moving the pair of grinding wheels to improve nanotopography of a wafer subsequently ground by the double side grinder.

4. The computer-implemented method of claim 1 wherein the determining includes determining a shift parameter based on the predicted nanotopography of the wafer, the shift parameter indicative of a direction for moving the pair of grinding wheels to improve nanotopography of a wafer subsequently ground by the double side grinder.

5. The computer-implemented method of claim 1 further comprising filtering the received warp data and wherein the predicting includes predicting a nanotopography of the wafer based on the filtered warp data.

6. The computer-implemented method of claim 1 wherein the predicting includes computing a profile for a surface of the wafer and wherein the determining includes determining a grinding parameter based on the computed profile of a region on the surface of the wafer having a radius of between 100 mm and 150 mm.

7. The computer-implemented method of claim 1 wherein the wafer as ground by the double side grinder is unetched and unpolished.

8. The computer-implemented method of claim 1 further comprising providing instructions for polishing the wafer and measuring a nanotopography of the polished wafer.

9. The computer-implemented method of claim 8 further comprising providing instructions for adjusting operation of the double side grinder based on the measured nanotopography of the polished wafer.

10. The computer-implemented method of claim 1 further comprising determining, by the processor, a tilt parameter indicative of an angle for positioning the pair of grinding wheels with respect to the wafer.

11. A computer-implemented method of improving nanotopography of a wafer ground by a double side grinder, the double side grinder having at least a pair of grinding wheels, the computer-implemented method comprising:

receiving, at a processor, data indicative of a profile of a wafer as ground by the double side grinder;

predicting a nanotopography of the wafer based on the received data;

determining a grinding parameter as a function of the received data; and providing feedback including the determined grinding parameter to the double side grinder to adjust the operation thereof.

12. The computer-implemented method of claim 11 wherein the determining includes determining a shift parameter based on the predicted nanotopography of the wafer, the shift parameter indicative of a magnitude for moving the pair of grinding wheels to improve nanotopography of a wafer subsequently ground by the double side grinder.

13. The computer-implemented method of claim 11 wherein the determining includes determining a shift parameter based on the predicted nanotopography of the wafer, the shift parameter indicative of a direction for moving the pair of grinding wheels to improve nanotopography of a wafer subsequently ground by the double side grinder.

14. The computer-implemented method of claim 11 wherein the receiving includes receiving data obtained by a warp measurement device for measuring warp of a wafer ground by the double side grinder, the wafer being unetched and unpolished.

15. A system for processing a semiconductor wafer using a double side grinder having a pair of wheels for grinding a wafer, the system comprising:

a measurement device for measuring data indicative of a profile of the ground wafer, wherein the measurement device is a warp measurement device for obtaining warp data from the ground wafer, the ground wafer being unetched and unpolished; and a processor configured for determining a grinding parameter as a function of the measured warp data;

wherein at least one of the wheels of the double side grinder is adjustable based at least in part on the determined grinding parameter.

16. The system of claim 15 wherein the measurement device includes a capacitive sensor for measuring data indicative of a profile of the ground wafer, the ground wafer being unetched and unpolished.

17. The system of claim 16 further comprising:

an etching device for etching the ground wafer;

a polishing device for polishing the etched wafer; and a nanotopography measurement device for measuring the nanotopography of the polished wafer.

18. The system of claim 15 wherein the processor is configured for determining a shift parameter as a function of the measured warp data, the shift parameter indicative of a magnitude for moving the pair of grinding wheels to improve nanotopography of a wafer subsequently ground by the double side grinder.

19. The system of claim 15 wherein the processor is configured for determining a shift parameter as a function of the measured warp data, the shift parameter indicative of a direction for moving the pair of grinding wheels to improve nanotopography of a wafer subsequently ground by the double side grinder.

20. A system for processing a semiconductor wafer using a double side grinder having a pair of wheels for grinding a wafer, the system comprising:

a measurement device for measuring data indicative of a profile of the ground wafer, wherein the measurement device includes a capacitive sensor for measuring data indicative of a profile of the ground wafer, the ground wafer being unetched and unpolished; and a processor configured for determining a grinding parameter as a function of the measured data;

wherein at least one of the wheels of the double side grinder is adjustable based at least in part on the determined grinding parameter.

21. The system of claim 20 wherein the measurement device is a warp measurement device for obtaining warp data from the ground wafer, the ground wafer being unetched and unpolished, and wherein the processor is configured for determining a grinding parameter as a function of the measured warp data.

22. The system of claim 20 further comprising:

an etching device for etching the ground wafer;

a polishing device for polishing the etched wafer; and a nanotopography measurement device for measuring the nanotopography of the polished wafer.

23. The system of claim 20 wherein the processor is configured for determining a shift parameter as a function of the measured data, the shift parameter indicative of a magnitude for moving the pair of grinding wheels to improve nanotopography of a wafer subsequently ground by the double side grinder.

24. The system of claim 20 wherein the processor is configured for determining a shift parameter as a function of the measured data, the shift parameter indicative of a direction for moving the pair of grinding wheels to improve nanotopography of a wafer subsequently ground by the double side grinder.

25. The system of claim 20 wherein the processor is configured for determining a shift parameter as a function of the measured data, the shift parameter indicative of a magnitude for moving the pair of grinding wheels to improve nanotopography of a wafer subsequently ground by the double side grinder.

26. A system for processing a semiconductor wafer using a double side grinder having a pair of wheels for grinding a wafer, the system comprising:

a measurement device for measuring data indicative of a profile of the ground wafer; and a processor configured for determining a grinding parameter as a function of the measured data, wherein the processor is configured for determining a shift parameter as a function of the measured data, the shift parameter indicative of a magnitude for moving the pair of grinding wheels to improve nanotopography of a wafer subsequently ground by the double side grinder;

wherein at least one of the wheels of the double side grinder is adjustable based at least in part on the determined grinding parameter.

27. The system of claim 26 wherein the measurement device is a warp measurement device for obtaining warp data from the ground wafer, the ground wafer being unetched and unpolished, and wherein the processor is configured for determining a grinding parameter as a function of the measured warp data.

28. The system of claim 26 wherein the measurement device includes a capacitive sensor for measuring data indicative of a profile of the ground wafer, the ground wafer being unetched and unpolished.

29. The system of claim 28 further comprising:

an etching device for etching the ground wafer;

a polishing device for polishing the etched wafer; and a nanotopography measurement device for measuring the nanotopography of the polished wafer.

30. The system of claim 26 wherein the processor is configured for determining a shift parameter as a function of the measured data, the shift parameter indicative of a direction for moving the pair of grinding wheels to improve nanotopography of a wafer subsequently ground by the double side grinder.

31. A system for processing a semiconductor wafer using a double side grinder having a pair of wheels for grinding a wafer, the system comprising:

a measurement device for measuring data indicative of a profile of the ground wafer; and a processor configured for determining a grinding parameter as a function of the measured data, wherein the processor is configured for determining a shift parameter as a function of the measured data, the shift parameter indicative of a direction for moving the pair of grinding wheels to improve nanotopography of a wafer subsequently ground by the double side grinder;

wherein at least one of the wheels of the double side grinder is adjustable based at least in part on the determined grinding parameter.

32. The system of claim 31 wherein the measurement device is a warp measurement device for obtaining warp data from the ground wafer, the ground wafer being unetched and unpolished, and wherein the processor is configured for determining a grinding parameter as a function of the measured warp data.

33. The system of claim 31 wherein the measurement device includes a capacitive sensor for measuring data indicative of a profile of the ground wafer, the ground wafer being unetched and unpolished.

34. The system of claim 33 further comprising:

an etching device for etching the ground wafer;

a polishing device for polishing the etched wafer; and a nanotopography measurement device for measuring the nanotopography of the polished wafer.

* * * * *